US006106368A

United States Patent [19]

Childers et al.

[11] Patent Number: 6,106,368

[45] Date of Patent: Aug. 22, 2000

[54] POLISHING METHOD FOR PREFERENTIALLY ETCHING A FERRULE AND FERRULE ASSEMBLY

[75] Inventors: Darrell R. Childers; James P. Luther, both of Hickory, N.C.

[73] Assignee: Siecor Operations, LLC, Hickory, N.C.

[21] Appl. No.: 09/195,776

[22] Filed: Nov. 18, 1998

[51] Int. Cl.[7] ..... B24B 1/00

[52] U.S. Cl. ..... 451/28; 451/41; 451/270

[58] Field of Search ..... 451/28, 41, 270, 451/271, 276, 278, 279, 259, 285, 287, 363, 366, 369, 532, 42, 49

[56] References Cited

U.S. PATENT DOCUMENTS

| | | |
|---|---|---|
| 2,554,701 | 5/1951 | Hackett et al. . |
| 2,796,702 | 6/1957 | Bodine . |
| 2,804,724 | 9/1957 | Thatcher . |
| 3,061,422 | 10/1962 | Sato . |
| 3,496,677 | 2/1970 | Bodine . |
| 3,535,159 | 10/1970 | Shiro . |
| 3,564,775 | 2/1971 | Bodine . |
| 3,589,071 | 6/1971 | Hirschhorn . |
| 3,596,407 | 8/1971 | McKinney . |
| 3,715,842 | 2/1973 | Tredinnick et al. . |
| 3,753,322 | 8/1973 | Bordes . |
| 3,922,393 | 11/1975 | Sears, Jr. . |
| 4,022,625 | 5/1977 | Shelton . |
| 4,057,939 | 11/1977 | Basi . |
| 4,218,849 | 8/1980 | Bodine . |
| 4,291,502 | 9/1981 | Grimsby et al. . |
| 4,693,035 | 9/1987 | Doyle . |
| 4,823,513 | 4/1989 | Marcus et al. . |
| 4,863,523 | 9/1989 | Meffert et al. . |
| 4,905,415 | 3/1990 | Moulin . |
| 4,979,334 | 12/1990 | Takahashi . |
| 5,040,336 | 8/1991 | Ahern . |
| 5,078,801 | 1/1992 | Malik . |
| 5,136,820 | 8/1992 | Luther . |

(List continued on next page.)

FOREIGN PATENT DOCUMENTS 2103919 5/1980 Germany .

OTHER PUBLICATIONS

Ultra Tec Fiber Optic Products catalog; Jun. 15, 1985.

Zimin, Savel'ev and Chutko, Use of ultrasonic processing for the fabrication of optical components having a complicated surface shape, Sov. J. Opt. Technol.; 53; Jan. 1986, pp. 55–56.

Moore, Uses of ultrasonic impact grinding (UIG) in optical fabrication, *SPIE* vol. 966; Advances in Fabrication and Metrology for Optics and Large Optics, 1988, pp. 122–127.

Tesar, Fuchs and Hed; Examination of the polished surface character of fused silica, *Applied Optics*, vol. 31, No. 34, Dec. 1, 1992, pp. 7164–7172.

Totoku Electric Co., Ltd. catalog, Totoku 8°APC, 1994.

Chen, Marom and Lee; Geodesic lenses in single–mode $LiNbO_3$ waveguides, *Applied Physics Letters*, vol. 31, No. 4, Aug. 15, 1977.

Zimin; Investigation of the technological process of ultrasonic finishing of polished surfaces of optical elements, Sov. J. Opt. Technol. 57, May 1990, pp. 309–311.

Doughty, DeLaRue, Finlayson, Singh and Smith; Integrated optical microwave spectrum analyser (IOSA) using geodesic lenses, SPIE, vol. 369 Max Born, pp. 705–710.

*Primary Examiner*—Timothy V. Eley
*Assistant Examiner*—Dung Van Nguyen
*Attorney, Agent, or Firm*—Michael L. Leetzow

[57] ABSTRACT

The face of a ferrule and ferrule assembly is polished in the present invention so a portion of optical fibers extending therethrough protrude beyond the front face of the ferrules. The ferrules are secured in a polisher and polished with a fibrous material that preferentially etches the ferrule relative to the optical fibers. The front face of the ferrule assembly is polished with a fibrous material having abrasive materials attached thereto, without the need for a slurry.

25 Claims, 3 Drawing Sheets

U.S. PATENT DOCUMENTS 5,140,660 8/1992 Takahashi .
5,140,779 8/1992 Grois ..... 51/217 R
5,214,730 5/1993 Nagasawa et al. .
5,216,846 6/1993 Takahashi .
5,226,101 7/1993 Szentesi et al. .
5,245,684 9/1993 Terao et al. .
5,264,010 11/1993 Brancaleoni et al. .
5,349,784 9/1994 Grois et al. ..... 451/314
5,351,327 9/1994 Lurie et al. .
5,351,445 10/1994 Takahashi ..... 451/271
5,447,464 9/1995 Franklin et al. ..... 451/28
5,464,361 11/1995 Suzuki et al. ..... 451/28
5,503,590 4/1996 Saitoh et al. ..... 451/11
5,516,328 5/1996 Kawada .
5,547,418 8/1996 Takahashi .
5,556,323 9/1996 Luther et al. .
5,601,474 2/1997 Takahashi .
5,667,426 9/1997 Minami et al. ..... 451/41
5,711,701 1/1998 Ginderslev et al. ..... 451/378
5,720,653 2/1998 Miller et al. ..... 451/278
5,743,785 4/1998 Lundberg et al. .
5,743,787 4/1998 Ishiyama et al. ..... 451/41
5,813,081 9/1998 Wang et al. ..... 15/210.1
5,947,807 9/1999 Overseth ..... 451/533

POLISHING METHOD FOR PREFERENTIALLY ETCHING A FERRULE AND FERRULE ASSEMBLY

TECHNICAL FIELD

This invention relates in general to methods for polishing a ferrule and ferrule assembly. More particularly, the method preferentially etches the ferrule relative to optical fibers extending through the ferrule assembly without the use of a slurry.

BACKGROUND ART

It is well known to polish ferrules and ferrule assemblies used in fiber optic connectors. The polishing of the fibers and ferrules after manufacture increases the transmission of the light signal through the fiber optic connector containing mated ferrule assemblies. Recently, advances in the ferrule assembly polishing art have evolved into polishing the front faces with a slurry (or multiple slurries) to achieve the desired characteristics. For example, U.S. Pat. No. 5,743,785 entitled "Polishing Method and Apparatus for Preferentially Etching a Ferrule Assembly and Ferrule Assembly Produced Thereby," which is incorporated herein in its entirety, discloses a method and apparatus for preferentially etching a ferrule assembly using two slurries. However, this method of polishing a ferrule is labor intensive and does not achieve the flatness of the array of optical fibers as required. After the first slurry is applied and the ferrule is polished, the ferrule assembly and machine must cleaned before the second slurry can be used. In order to clean the slurry from the ferrules, the polishing fixture holding the ferrule assemblies is removed and washed in a sink. The polishing disc must also be washed to remove any remaining slurry. The ferrule assembly and machine must again be cleaned after the second slurry is used. Additionally, the slurry and particles accumulate in crevices and alignment holes in the ferrules, requiring yet more operator cleaning. Slurry polishing of ferrules is also less than ideal for multi-mode fibers due to their softer cores. The slurry tends to preferentially polish out the centers of the fibers, leaving a concave end on the optical fibers. This concave end, or cupping effect of the fibers, prevents close physical contact of the optical fibers to be mated.

DISCLOSURE OF THE INVENTION

Among the objects of the present invention is a method for polishing a ferrule assembly that is less labor intensive, does not require the removal of the polishing fixture to clean the ferrules during or after the polishing, and provides the required optical fiber protrusion from the end face of the ferrule.

Other objects and advantages of the present invention will become apparent from the following detailed description when viewed in conjunction with the accompanying drawings, which set forth certain embodiments of the invention. The objects and advantages of the invention will be realized and attained by means of the elements and combinations particularly pointed out in the appended claims.

To achieve the objects and in accordance with the purposes of the invention as embodied and broadly described herein, the invention comprises a method of polishing a ferrule assembly comprising the steps of providing a ferrule assembly comprising a ferrule having a front face and an opposed rear face and defining at least one opening extending between the opposed front and rear faces, the ferrule assembly further comprising at least one optical fiber extending through a respective opening such that an end portion of the at least optical fiber is exposed through the front face of the ferrule, and polishing the front face of the ferrule with a fibrous material, the material preferentially etching the ferrule relative to the each optical fiber such that the end portion of each optical fiber protrudes beyond the preferentially etched front face of the ferrule by a preselected length.

To achieve the objects and in accordance with the purposes of the invention as embodied and broadly described herein, the invention is also directed to a method of polishing a ferrule assembly comprising the steps of providing a ferrule assembly comprising a ferrule having a front face and an opposed rear face and defining at least one opening extending between the opposed front and rear faces, the ferrule assembly further comprising at least one optical fiber extending through a respective opening such that an end portion of the at least one optical fiber is exposed through the front face of the ferrule, and polishing the front face of the ferrule with a fibrous material having particles attached thereto, the material preferentially etching the ferrule relative to the each optical fiber, the polishing step comprising the steps of securing the fibrous material to a polishing disc having an axis, rotating the polishing disc, turning the polishing disc about an eccentric axis offset from the polishing disc axis simultaneously with the step of rotating such that the polishing disc rotates and oscillates simultaneously to preferentially etch the ferrule relative to the each optical fiber such that the end portion of each optical fiber protrudes beyond the preferentially etched front face of the ferrule by a preselected length.

To achieve the objects and in accordance with the purposes of the invention as embodied and broadly described herein, the invention is also directed to a ferrule assembly comprising a ferrule having a front face and an opposed rear face and defining at least one opening extending between the opposed front and rear faces, wherein the ferrule assembly is manufactured according to the method comprising the steps of securing at least one fiber in a respective opening; and polishing the front face of the ferrule with a fibrous material, the material having particles attached thereto for preferentially etching the ferrule relative to the each optical fiber such that the end portion of each optical fiber protrudes beyond the preferentially etched front face of the ferrule by a preselected length.

It is to be understood that both the foregoing general description and the following detailed description are exemplary and explanatory only and are not restrictive of the invention as claimed.

The accompanying drawings, which are incorporated in and constitute a part of this specification, illustrate several embodiments of the invention and, together with the description, serve to explain the principles of the invention.

DETAILED DESCRIPTION OF THE PREFERRED EMBODIMENTS

Figure 1:
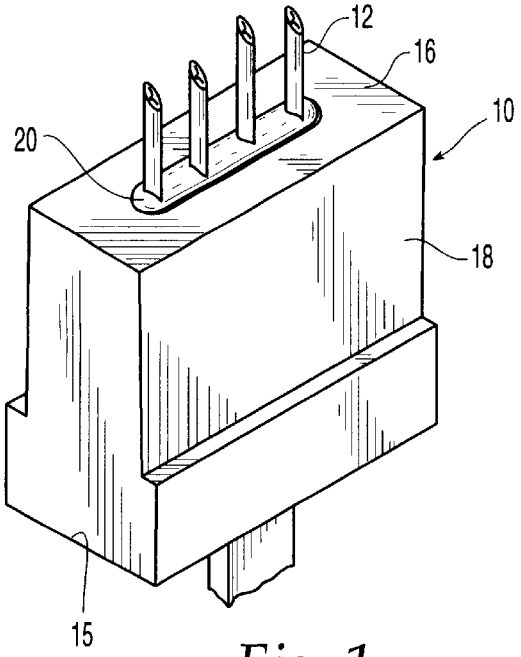
FIG. 1 is a perspective of a ferrule assembly according to the present invention having a ferrule and a plurality of optical fibers extending beyond an end face thereof.
Figure 2:
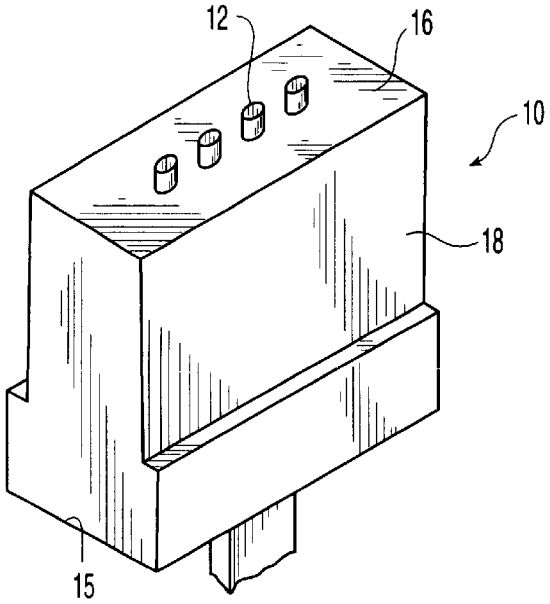
FIG. 2 is an exaggerated perspective of the ferrule assembly in FIG. 1 after polishing of the ferrule end face.
Figure 3:
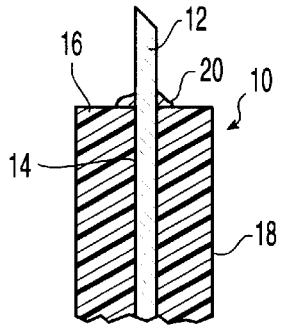
FIG. 3 is a cross-sectional view of the ferrule assembly of FIG. 1.
Figure 6:
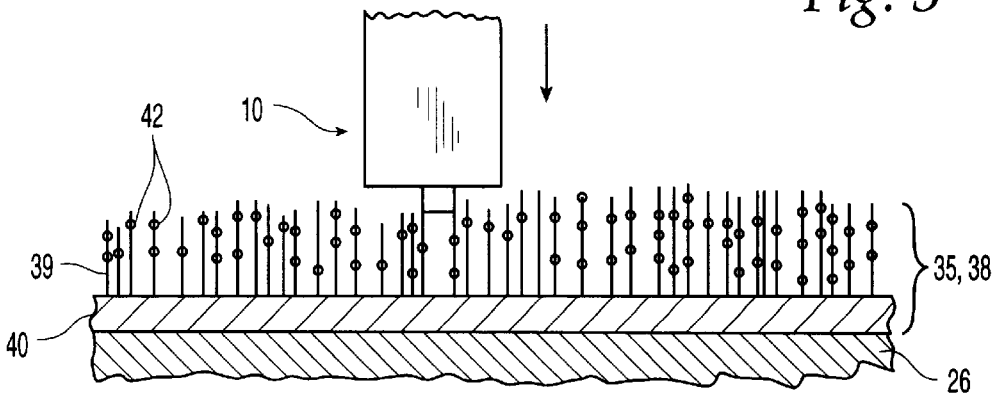
FIG. 6 is a greatly enlarged cross-sectional view of the ferrule assembly engaging the polishing material according to the present invention.

Referring to FIGS. 1–3, a ferrule assembly 10 is shown (greatly enlarged) with optical fibers 12 extending through holes 14 from a rear face 15 through a front face 16 of ferrule 18. In the preferred embodiment, the optical fibers 12 are secured within the holes 14 in ferrule 18 by epoxy 20. An MT ferrule with four optical fibers is shown in the figures. It is to be understood that any number of fibers (and holes in ferrule 18) or any type of ferrule 18, including, for example, DC, ST, FC, etc. styles, are within the scope of the present invention. Moreover, both single mode fibers and multi-mode fibers can both be used in an appropriate ferrule.

After the fibers 12 are secured in the ferrule 18, the protruding optical fibers are scored and removed as close as possible to the epoxy bead 20, which results from securing the fibers 12 in the ferrule 18. Then the ferrule assembly 10 is polished by hand with a silicon carbide film to bring the fibers 12 into an even closer proximity to the epoxy bead 20 (some epoxy may even be removed). After the ferrule is hand polished, the ferrule assembly 10 is inserted into and polished with a polishing apparatus. The polishing apparatus is similar to that disclosed in U.S. Pat. No. 5,743,785, except a different jig 24 is used to hold the ferrule assembly 10.

Figure 4:
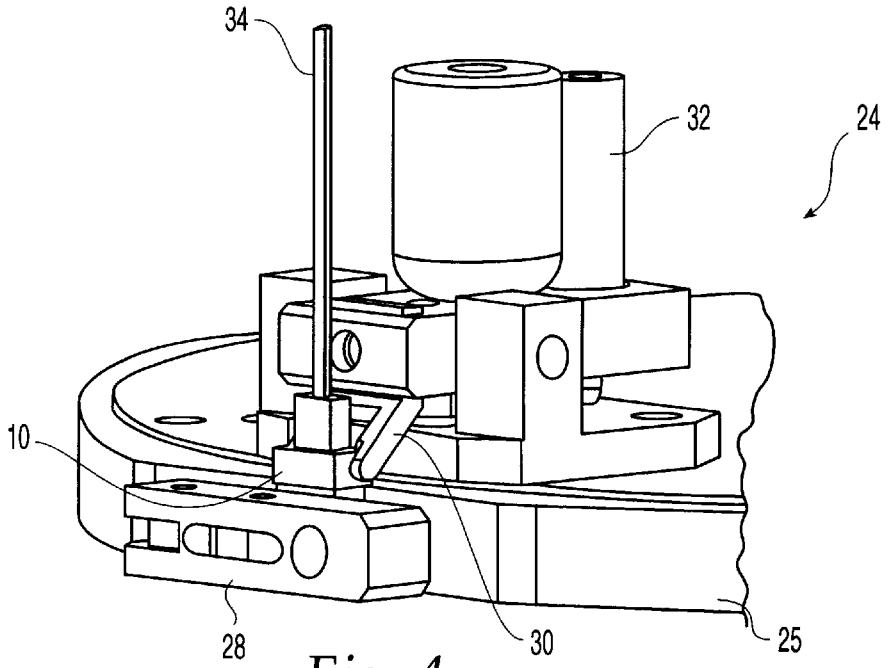
FIG. 4 is a perspective of the ferrule assembly in a portion of the polishing apparatus according to one embodiment.
Figure 5:
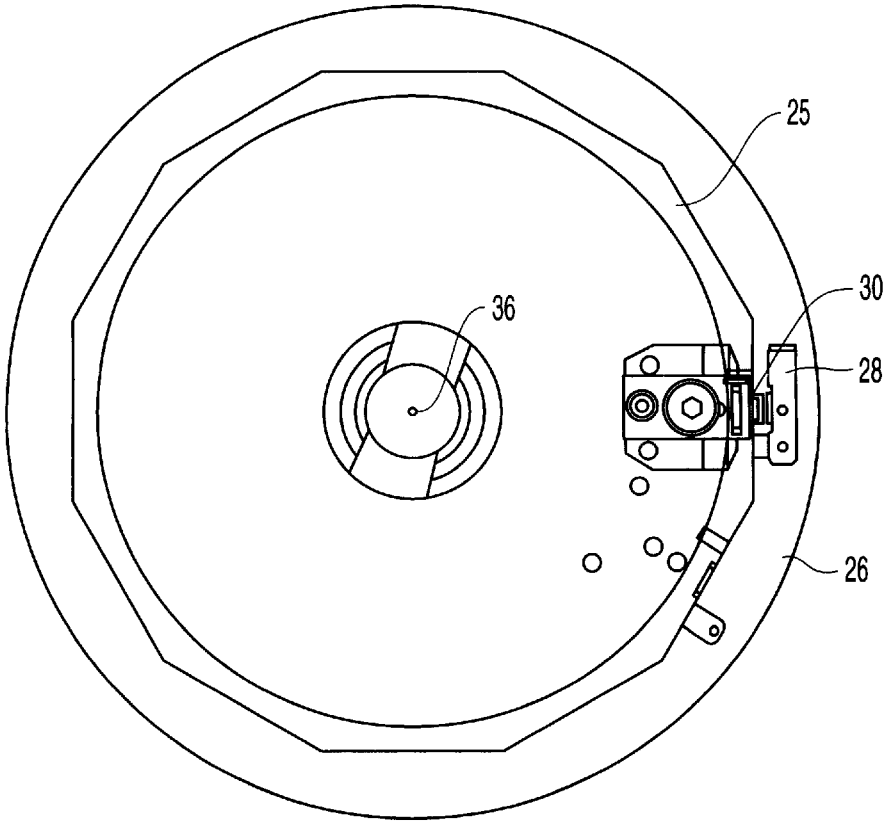
FIG. 5 is a top view of the portion of the polishing apparatus in FIG. 4 with the polishing disc.

The ferrule assembly 10 is loaded into the jig 24 on polishing fixture 25 with the front face oriented toward the polishing disc 26, with the optical fibers oriented at about 90° relative to the surface of the polishing disc 26. As seen in FIGS. 4 and 5, the ferrule assembly 10 is held by a front mounted, side swing clamp 28 and a toggle clamp 30 that holds the front face 16 of the ferrule 18 parallel to the polishing disc 26 even if the rear face 15 is not parallel. A ball plunger 32 is used in conjunction with the toggle clamp 30 to hold the ferrule assembly (with an optical fiber ribbon 34 shown in FIG. 4 or other suitable cable sub-unit) at a constant pressure and parallel to the polishing disc 26.

Figure 7:
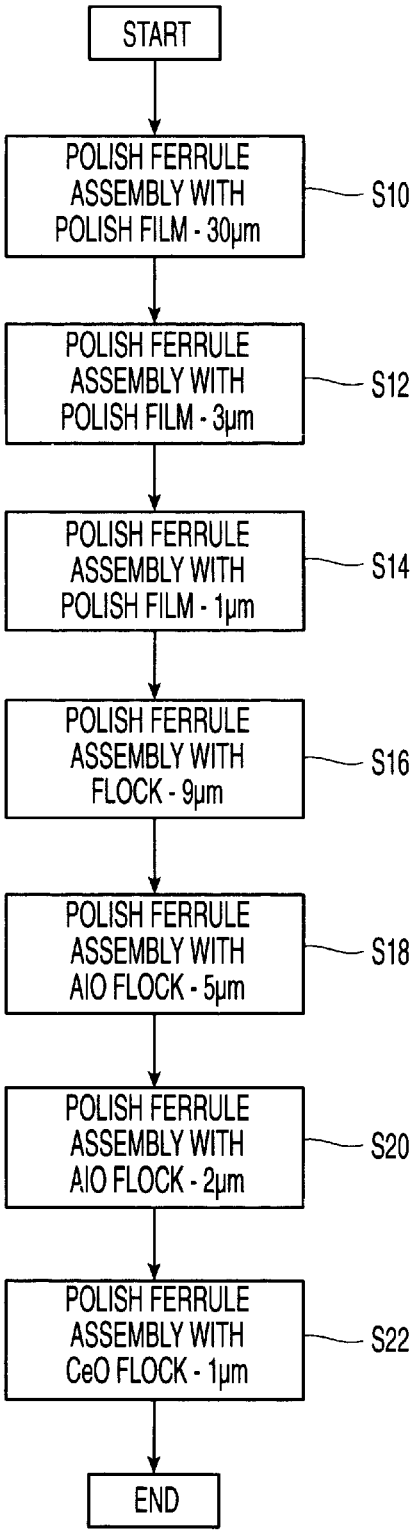
FIG. 7 is a flow chart illustrating the polishing method for a single mode optical fiber in accordance with the present invention.

The ferrule assembly 10 is then polished according to the steps shown in FIG. 7, which illustrates a polishing method for a single mode fiber. For a multi-mode fiber, the polishing method is slightly different due to the different characteristics of the fibers, which is explained below. While only one ferrule is shown to be loaded into jig 24 on polishing fixture 25 in FIG. 5, the polishing fixture 25 is capable of holding a plurality of jigs 24 and ferrule assemblies 10 at one time, and most preferably is capable of having twelve jigs and ferrule assemblies mounted at any time. With reference to FIG. 5, which only shows one mounted ferrule, it can be clearly seen that twelve jigs could be mounted. Once loaded, the ferrule assembly 10 is lowered to engage the polishing disc 26 and more particularly, a polishing medium 35 removably attached to the polishing disc 26. As more fully explained in the '785 patent, the polishing disc rotates about a disc axis 36 and orbits (oscillates) about an offset axis, which is offset from the disc axis 36. The dual motion of the disc 26 relative to the ferrule assembly 10 allows not only for polishing of the ferrule front face 16 by new portions of the polishing medium 35 (rotation), but also polishing from different directions to prevent edge effects (orbiting/oscillation). As shown in FIG. 7, the ferrule assembly 10 is first polished for 15 seconds at step S10 with a 30 $\mu$m silicon carbide polishing film as the polishing medium 35, available from Mipox International Corp., Hayward, Calif. Step S10 is performed dry, that is without any lubrication. Next, at step S12, the 30 $\mu$m silicon carbide polishing film is replaced with a 3 $\mu$m silicon carbide polishing film, and the ferrule assembly 10 is polished with water for 30 seconds. Water is also used as a lubricant with the remaining polishing steps. At step S14, a 1 $\mu$m silicon carbide polishing film is used on the ferrule for 30 seconds, using 1.75 pounds of pressure, the same pressure on the ferrule assembly 10 for steps S10 and S12. These polishing steps are used to condition the ferrule assembly 10 to ensure a smooth parallel face, free from the epoxy bead 20 and other inconsistencies on the front face 16.

The ferrule assembly 10 is then polished with a flocked material 38 (having small fibers 39 extending upwardly from a polyethylene terephthalate base material 40) as the polishing medium 35, the flocked material 38 having abrasive particles 42 attached to the fibers 39. The flocked material is available from Mipox International Corp, FP1004-50P-N-B, from the FP tape series. Using four pounds of pressure and water as a lubricant, the ferrule assembly 10 is polished with the flocked material for 45 seconds in each of steps S16, S18, S20, and S22 However, in each of those steps, the abrasives attached to the flocked material change in average size and composition. Step S16 uses a 9 $\mu$m (average size) silicon carbide flocked material. Steps S18 and S20 use a 5 $\mu$m and a 2 $\mu$m (average sizes) aluminum oxide flocked material, respectively. Step S22 then finishes the polishing of the single mode fiber with a 1 $\mu$m (average size) cerium oxide flocked material.

At the end of step S14, the front face 16 of the ferrule 18 is flat, with the optical fibers 12 flush with front face 16. The flocked material 38 preferentially removes the ferrule material relative to the optical fibers 12 in steps S16–S22, but it also polishes the optical fibers 12 as well. The fibers 39, being attached to the base material 40 at only one end, are relatively flexible and compliant, allowing for a preferential etching of the softer ferrule 18 relative to the harder optical fibers 12. These differences allow the front face 16 of the ferrule assembly 10 to have optical fibers 12 protruding by the same amount, thereby allowing a better joining point (i.e., less back reflection, insertion loss, etc.) with each of the optical fibers in a similar ferrule assembly.

Using this process, there is no need to clean the ferrules, apparatus, or the discs as in the '785 patent with this process since the particles are attached to the fibers rather than being suspended in a liquid slurry. (The ferrules are sprayed with water between steps to remove any it loose ferrule material or particles from the flocked material and ensure a clean surface, but the polishing fixture 25 need not be removed and washed.)

For a multi-mode fiber, there is a concern with etching out the softer, wider optical fiber core. Therefore, the process for polishing ferrules with multi-mode optical fibers requires that the number of steps and duration those steps be reduced to account for the softer optical fiber core. Additionally, the abrasive materials must also be carefully chosen such that they do not preferentially remove the optical fiber core. Specifically, the ferrule assembly 10 is first dry polished for 45 seconds with the 30 $\mu$m silicon carbide polishing film. Similar to the single mode ferrule assembly discussed above, it is then polished with the 3 $\mu$m and the 1 $\mu$m silicon carbide polishing films with water for 30 seconds under 1.75 pounds pressure to achieve a flat front face 16. Finally, and in contrast to the single mode fiber ferrule assemblies, the multi-mode assemblies are polished using the same flocked material in only two steps. Both steps use a 1 μm (average size) aluminum oxide flocked material and each lasts for 45 seconds with water used as a lubricant. Cerium oxide is not as hard as the aluminum oxide, and, if used, it would preferentially remove the softer optical fiber core in multimode fibers. Therefore, it is not used as it is for the single mode fibers.

The use of other compliant, resilient materials having abrasive particles attached thereto would also be within the scope of the invention. For example, Mipox makes a synthetic leather material (a porous polyurethane, Mipox part number AO-3-66-SW) that has white fused alumina with an average size of 3.025 μm attached to the material. Due to the resilience and compliance characteristics of the material, the ferrule assembly 10 can be pressed into the material and the abrasive materials then preferentially remove the ferrule from around the optical fibers, without significant removal of the optical fibers. A woven nylon material with abrasive particles attached thereto can also be used on the polishing disc. Again, the woven nylon is resilient and compliant, preferentially removing the ferrule from around the optical fibers. While specific abrasive materials have been noted above, the use of other comparable materials, such as silicon dioxide, is also within the scope of the present invention.

The method of the present invention, and the resulting ferrule assembly, allows for optical fibers protruding from the front face of the ferrule, but with a flatter fiber array profile that the slurry processes have been able to achieve.

We claim:

1. A method of polishing a ferrule assembly comprising the steps of:

providing a ferrule assembly comprising a ferrule having a front face and an opposed rear face and defining at least one opening extending between the opposed front and rear faces, the ferrule assembly further comprising at least one optical fiber extending through a respective opening such that an end portion of the at least once optical fiber is exposed through the front face of the ferrule; and polishing the front face of the ferrule with a fibrous material, the material preferentially etching the front face of the ferrule relative to the at least one optical fiber such that the end portion of the at least one optical fiber protrudes beyond the preferentially etched front face of the ferrule by a preselected length.

2. The method of claim 1, wherein the fibrous material has particles attached thereto.

3. The method of claim 2, further comprising the step of:

supporting the fibrous material on a polishing disc during the step of polishing the front face; and biasing the ferrule assembly toward the polishing disc during the polishing step to facilitate the preferential etching of the ferrule relative to the at least one optical fiber.

4. The method of claim 2 wherein the particles are selected from the group including silicon oxide, aluminum oxide, and cerium oxide.

5. The method of claim 2 wherein each optical fiber is a multimode fiber, and the particles are selected from the group including silicon oxide and aluminum oxide.

6. The method of claim 2 wherein each optical fiber is a single mode fiber, and the particles are selected from the group including silicon dioxide, aluminum oxide, silicon carbide, and cerium oxide.

7. The method of claim 2 wherein the particles are bonded to the fibrous material.

8. The method of claim 2, wherein a lubricant is used during the polishing step.

9. The method of claim 8, wherein the lubricant is water.

10. The method of claim 2, wherein the polishing step is further comprised of a plurality of polishing substeps, each substep using a fibrous material with particles having a decreasing size on average.

11. The method of claim 2, wherein the polishing step is further comprised of a plurality of polishing substeps, each substep using a fibrous material having a different type of particle.

12. The method of claim 1 wherein the fibrous material has a backing material and the fibrous material is nylon attached to the backing material.

13. The method of claim 1 wherein the backing material is polyethylene terephthalate.

14. The method of claim 1 wherein the fibrous material has a backing material and the fibrous material is woven nylon attached to the backing material.

15. The method of claim 1, the polishing step further comprising the substeps of:

polishing the front face with a fibrous material having a first particle type attached thereto;

polishing the front face with a fibrous material having a second particle type attached thereto.

16. The method of claim 1, the polishing step further comprising the substeps of:

polishing the front face with the fibrous material having particles attached thereto, the particles having a first size on average; and polishing the front face with the fibrous material having particles attached thereto, the particles having a second size on average.

17. The method of claim 1, wherein the step of providing a ferrule assembly further comprises the substeps of:

securing the at least one optical fiber in the at least one opening;

removing any optical fiber extending beyond the front face of the ferrule; and buffing the front face.

18. A method of polishing a ferrule assembly comprising the steps of:

providing a ferrule assembly comprising a ferrule having a front face and an opposed rear face and defining at least one opening extending between the opposed front and rear faces, the ferrule assembly further comprising at least one optical fiber extending through a respective opening such that an end portion of the at least one optical fiber is exposed through the front face of the ferrule; and polishing the front face of the ferrule with a fibrous material having particles attached thereto, the material preferentially etching the front face of the ferrule relative to the at least one optical fiber, the polishing step comprises the steps of:

securing the fibrous material to a polishing disc, the polishing disc having an axis;

rotating the polishing disc;

turning the polishing disc about an eccentric axis offset from the polishing disc axis simultaneously with the step of rotating such that the polishing disc rotates and oscillates simultaneously to preferentially etch the ferrule relative to the at least one optical fiber such that the end portion of at least one optical fiber protrudes beyond the preferentially etched front face of the ferrule by a preselected length.

19. The method of claim 18, wherein the polishing step is performed at least two different times, each time the fibrous material has a different particle attached thereto.

20. The method of claim 18, wherein the polishing step is performed a plurality of times, the particles having a different particle size on average during each subsequent polishing step.

21. A ferrule assembly having a ferrule having a ferrule having a front face and an opposed rear face and defining at least one opening extending between the opposed front and rear faces, wherein the ferrule assembly is manufactured according to the method comprising the steps of:

securing at least one fiber in a respective opening; and polishing the front face of the ferrule with a fibrous material, the material having particles attached thereto for preferentially etching the front face of the ferrule relative to the at least one optical fiber such that the end portion of the at least one optical fiber protrudes beyond the preferentially etched front face of the ferrule by a preselected length.

22. The ferrule assembly of claim 21, the polishing step further comprising the substeps of:

polishing the front face with the fibrous material having particles attached thereto, the particles having a first size on average; and polishing the front face with the fibrous material having particles attached thereto, the particles having a second size on average.

23. The ferrule assembly of claim 21, the polishing step further comprising the substeps of:

polishing the front face with a fibrous material having a first particle type attached thereto;

polishing the front face with a fibrous material having a second particle type attached thereto.

24. The ferrule assembly of claim 21, the polishing step further comprising the substep of providing a lubricant during the polishing step.

25. The ferrule assembly of claim 21, the polishing step further comprising the substeps of:

removing any optical fiber extending beyond the front face of the ferrule; and buffing the front face to remove any remaining optical fiber prior to the polishing step.

* * * * *

UNITED STATES PATENT AND TRADEMARK OFFICE

CERTIFICATE OF CORRECTION

PATENT NO. : 6,106,368

DATED : August 22, 2000

INVENTOR(S) : Darrell R. Childers, James P. Luther

It is certified that error appears in the above-identified patent and that said Letters Patent is hereby corrected as shown below:

COL. 7, LINE 8, delete first occurrence --having a ferrule--

Signed and Sealed this

First Day of May, 2001

*Attest:*

Nicholas P. Godici

NICHOLAS P. GODICI

*Attesting Officer*

*Acting Director of the United States Patent and Trademark Office*